US008336688B2

(12) United States Patent
Chen et al.

(10) Patent No.: US 8,336,688 B2
(45) Date of Patent: Dec. 25, 2012

(54) THIN CABLE RETRACTOR

(76) Inventors: Ko-An Chen, Taipei (TW); Wen-Han Chang, Taipei (TW)

( * ) Notice: Subject to any disclaimer, the term of this patent is extended or adjusted under 35 U.S.C. 154(b) by 251 days.

(21) Appl. No.: 12/959,390

(22) Filed: Dec. 3, 2010

(65) Prior Publication Data

US 2012/0138724 A1 Jun. 7, 2012

(51) Int. Cl.
*B65H 75/48* (2006.01)

(52) U.S. Cl. ..... 191/12.2 R; 191/12.2 A

(58) Field of Classification Search ..... 191/12.2 R, 191/12.4, 12.2 A; 242/371, 375.3, 378.1; 439/501; 33/413, 414; 160/170
See application file for complete search history.

(56) References Cited

U.S. PATENT DOCUMENTS

| | | | | |
|---|---|---|---|---|
| 6,149,094 | A * | 11/2000 | Martin et al. | 242/373 |
| 6,601,635 | B2 * | 8/2003 | Ciuca et al. | 160/170 |
| 6,761,203 | B1 * | 7/2004 | Huang | 160/170 |
| 7,255,595 | B2 * | 8/2007 | Lo | 439/501 |
| 7,406,995 | B2 * | 8/2008 | Huang | 160/170 |
| 7,458,536 | B2 * | 12/2008 | Hui | 242/375.3 |

* cited by examiner

*Primary Examiner* — Mark Le
(74) *Attorney, Agent, or Firm* — Leong C. Lei

(57) ABSTRACT

The cable retractor mainly contains a housing member, a coil spring, a rotary disc, a cable, and a winding disc. The rotary disc has a top circular indentation where the coil spring is accommodated in the indentation. A number of gear teeth are provided around the rotary disc and the winding disc. The winding disc has a central axle for the winding of the cable. The winding disc is positioned such that its teeth engage those of the rotary disc. A spiral track and a centrifugal track are provided on the rotary disc and the housing member, respectively. A positioning ball, together with the spiral track and the centrifugal track, provides a positioning function. The cable can be configured to be pulled in a single direction with a connector or multiple directors at a free end.

5 Claims, 6 Drawing Sheets

THIN CABLE RETRACTOR

(a) TECHNICAL FIELD OF THE INVENTION

The present invention is generally related to cable retractors and more particularly to a cable retractor whose winding disc and coil spring are arranged laterally so as to reduce the size of the cable retractor.

(b) DESCRIPTION OF THE PRIOR ART

Due to the wide popularity of various portable appliances, such as mobile phones, notebook or tablet computers, etc., various cables for these appliances, such as earphone cables, signal cables, power cables, etc., are necessary auxiliaries but they are annoying as they are often tangled and twisted.

Conventionally, people just wind the cables to some desired length and tie them up. However, this still cannot prevent the cables from tangling. Most importantly, cable being wound and tied for too long would cause its transmission and safety quality to deteriorate.

As such, cable retractors are produced and introduced to solve the cable management problem. A conventional cable retractor involves a winding disc where the cable is wound on one side and a coil spring is provided on the other side. When the cable is pulled out, the coil spring is tightened and, when the coil spring is released, the cable is reeled back in. As the coil spring and the cable are stacked vertically, the cable retractor cannot be downsized to make it more compact.

SUMMARY OF THE INVENTION

As such, a novel cable retractor is provided where its winding mechanism is laterally arranged so that the height of the cable retractor could be significantly reduced.

The cable retractor mainly contains a housing member, a coil spring, a rotary disc, a cable, and a winding disc. The rotary disc has a top circular indentation where the coil spring is accommodated in the indentation. Depending on whether the rotary disc spins clockwise or counter-clockwise, the coil spring is tightened or loosed. A number of gear teeth are provided around the rotary disc. A number of gear teeth are also provided along the winding disc. The winding disc has a central axle for the winding of the cable. The winding disc is positioned such that its teeth engage those of the rotary disc.

A spiral track and a centrifugal track are provided on the rotary disc and the housing member, respectively. A positioning ball, together with the spiral track and the centrifugal track, provides a positioning function. As the rotary disc spins, the winding disc is engaged to rotate in the opposite direction as well. Every time the winding disc is rotated one round, the positioning ball is allowed to temporarily stop the cable at its current extended length.

The cable can be configured to be pulled in a single direction with a connector or multiple directors at a free end.

For the single-connector configuration, a connector is configured at a free end of the cable while a positive wire and a negative wire out of the other end of the cable are connected to an upper embedded element. The upper embedded element connects one of the positive and negative wires to an upper conducting plate, and the other wire to a lower conducting plate through a lower embedded element. On the other hand, the positive and negative wires of another connector of fixed length are connected to the upper and lower conducting plates, respectively.

As to the two-connector configuration, the cable is bended at a central location and the central location is fixed to the central axle of the winding disc. The entire cable is then wound around the central axle so that two connectors at the two ends of the cable could be pulled and extended in the same direction.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
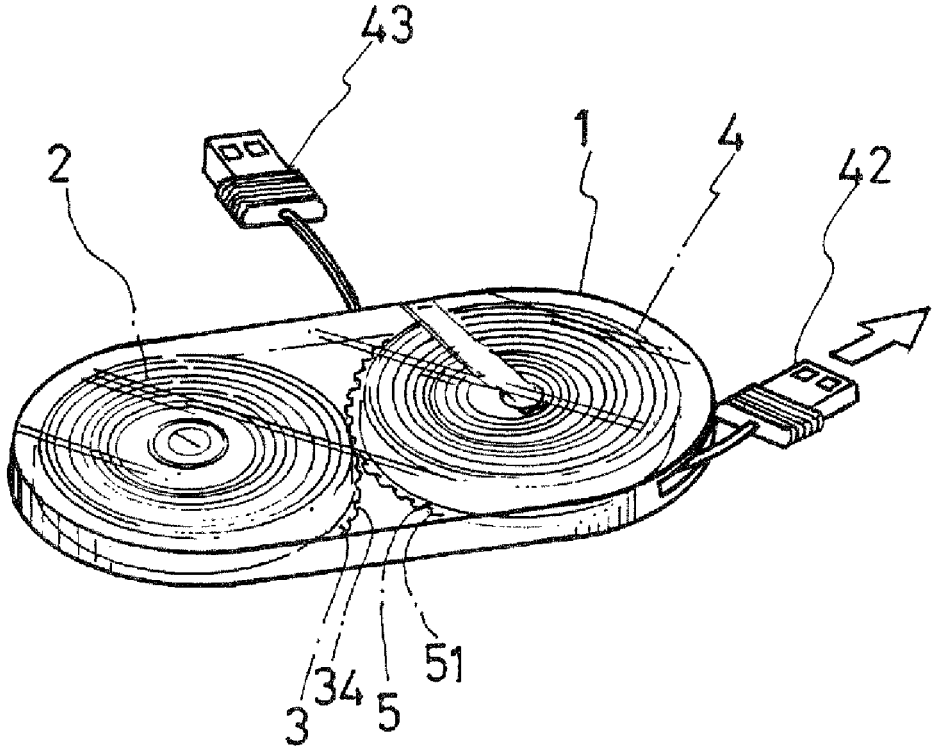
FIG. 1 is a perspective schematic diagram showing a thin cable retractor according to an embodiment of the present invention which provides a retractable cable with a single connector at a free end.
Figure 3:
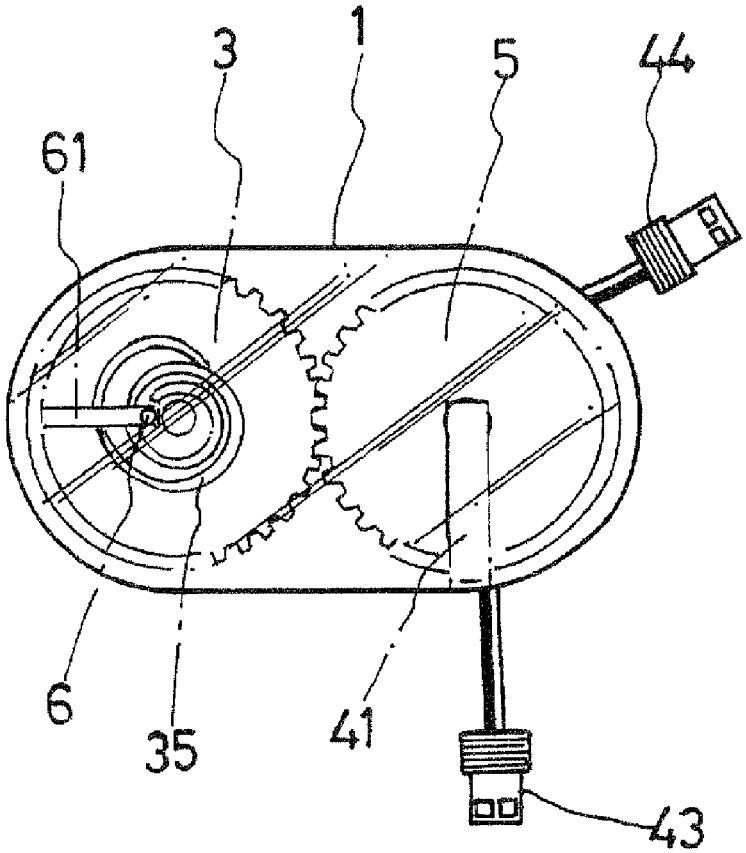
FIG. 3 is a top-view schematic diagram showing various components of the thin cable retractor of FIG. 1.
Figure 7:
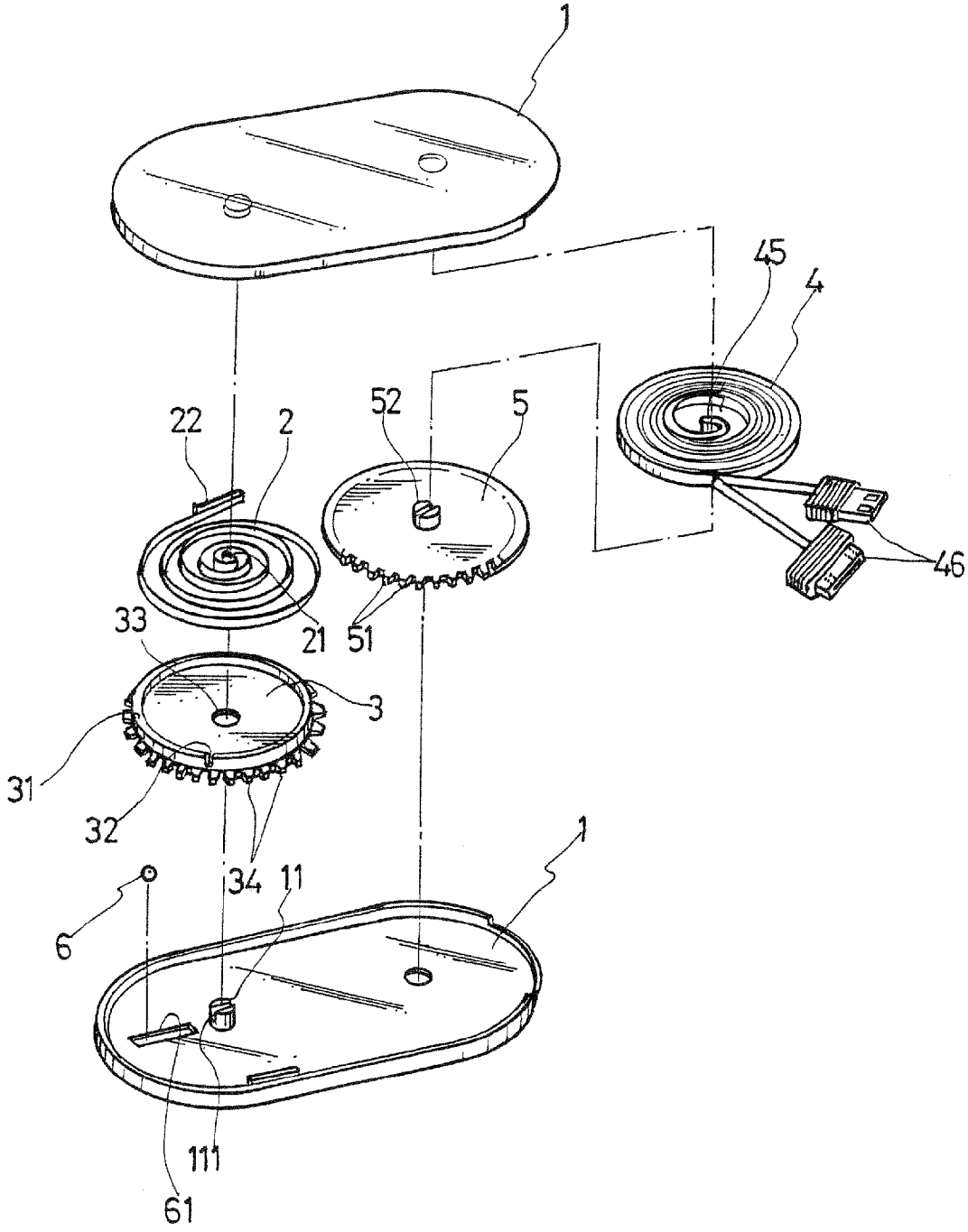
FIG. 7 is a perspective break-down diagram showing the various components of the thin cable retractor of FIG. 6.

As shown in FIGS. 1, 3, and 7, a cable retractor according an embodiment of the present invention mainly contains a housing member 1, a coil spring 2, a rotary disc 3, a cable 4, and a winding disc 5. The rotary disc 3 has a top circular indentation 31 with a central through hole 33. The rotary disc 3 is axially mounted on a pin 11 of the housing member 1 so that the rotary disc 3 freely spins around the pin 11. The coil spring 2, accommodated in the indentation 31, has an inner end 21 embedded into a notch 111 on atop end of the pin 11, and an outer end 22 embedded into a notch 32 along a circumferential wall of the indentation 31. As such, depending on whether the rotary disc 3 spins clockwise or counter-clockwise, the coil spring 2 is tightened or loosed. A number of gear teeth 34 are provided around the rotary disc 3 for engaging with the winding disc 5.

As shown in FIGS. 3 and 7, a number of gear teeth 51 for engaging with those of the rotary disc 3 are provided along a section of the circumference of the winding disc 5. The winding disc 5 has a central axle 52 for the winding of the cable 4. Additionally, the winding disc 5 is rotatably mounted to the housing member 1 and is positioned such that its teeth 51 engage those of the rotary disc 3. As such, the winding disc 5 rotates along with the rotary disc 3's spinning, and the energy stored in and released from the coil spring 2 is delivered to the winding disc 5 to wind or unwind the cable 4.

As shown in FIG. 3, a spiral track 35 and a centrifugal track 61 are provided on a back side of the rotary disc 3 and the housing member 1, respectively. A positioning ball 6 is movably positioned inside the spiral track 35 and the centrifugal track 61. Together with the spiral track 35 and the centrifugal track 61, the positioning ball 6 provides a positioning function capable of temporarily stopping the extension and winding of the cable in successive steps. When the cable 4 is pulled, the winding disc 5 is rotated and the rotary disc 3 is engaged to spin, the coil spring 2 is tightened and energy is stored for later retracting the cable 4. To retract the cable 4, the coil spring 2 is released and the rotary disc 3 spins in the opposite direction by the energy stored in the coil spring 2. As the rotary disc 3 spins, the winding disc 5 is engaged to rotate in the opposite direction as well to wind the cable 4 back in. Every time the winding disc 5 is rotated one round (equivalent to a round of the rotary disc 3), the positioning ball 6 is allowed to temporarily stop the cable 4 at its current extended length. Therefore, during the pulling and releasing the cable 4, there are multiple chances to stop the cable 4 at various lengths.

Figure 2:
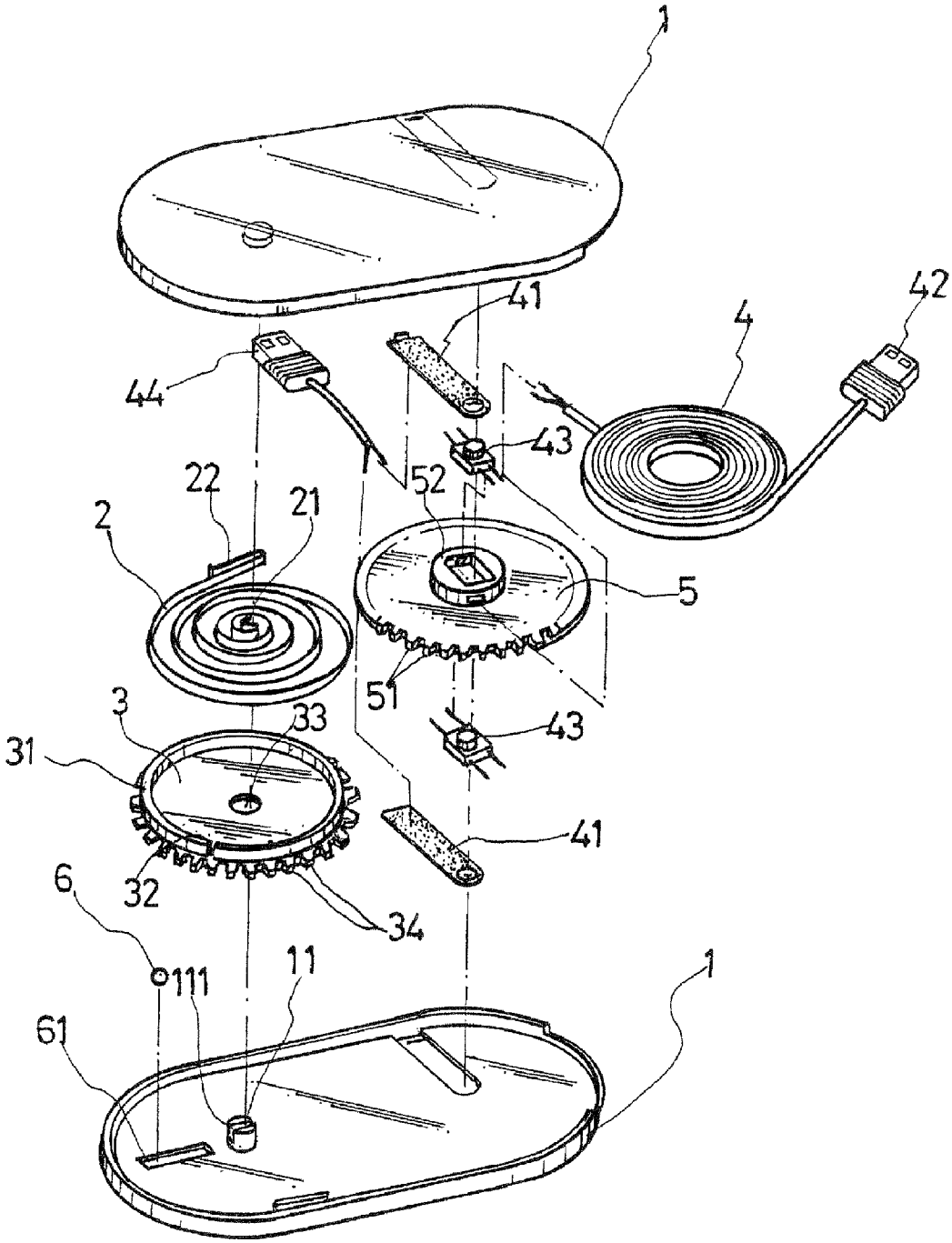
FIG. 2 is a perspective break-down diagram showing the various components of the thin cable retractor of FIG. 1.

As shown in FIGS. 2 and 7, the cable 4 can be configured to be pulled in a single direction with a connector or multiple directors at a free end.

Figure 4:
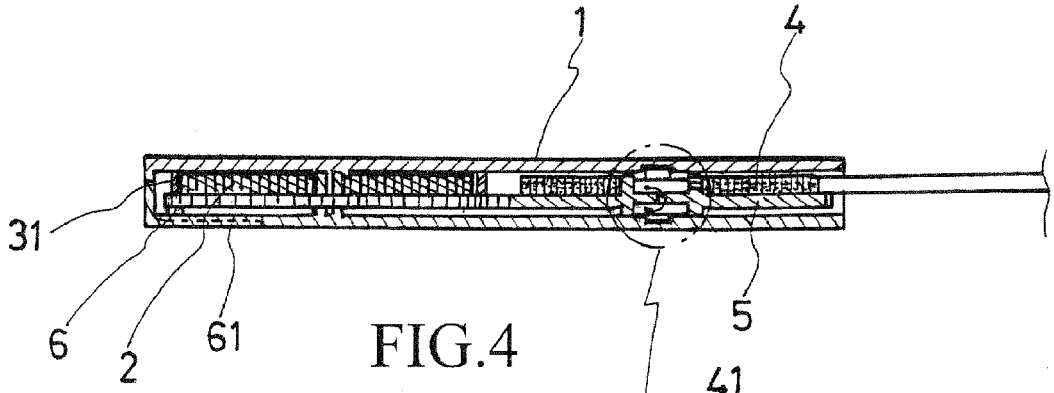
FIGS. 4 and 5 are sectional schematic diagrams showing how wires of the cable are connected inside the cable retractor of FIG. 1.
Figure 5:
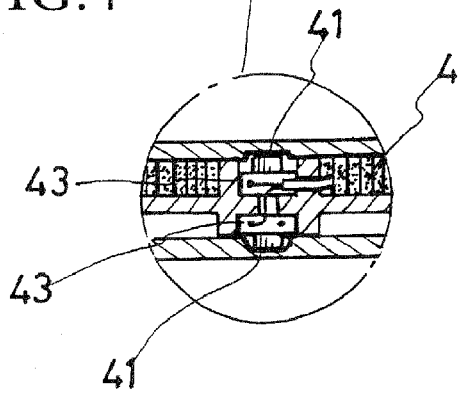

As shown in FIG. 2, a connector 42 is configured at a free end of the cable 4 while a positive wire and a negative wire out of the other end of the cable 4 are connected to an upper embedded element 43 and a lower embedded element 43, respectively. The upper embedded element 43 then connects an upper conducting plate 41, and the lower embedded element 43 connects a lower conducting plate 41. On the other hand, the positive and negative wires of another connector 44 are connected to the upper and lower conducting plates 41, respectively, as shown in FIGS. 1, 4, and 5. In the present embodiment, the connector 42 at the cable 4's free end could be pulled to a desired length while the connector 44 is at a fixed length.

Figure 6:
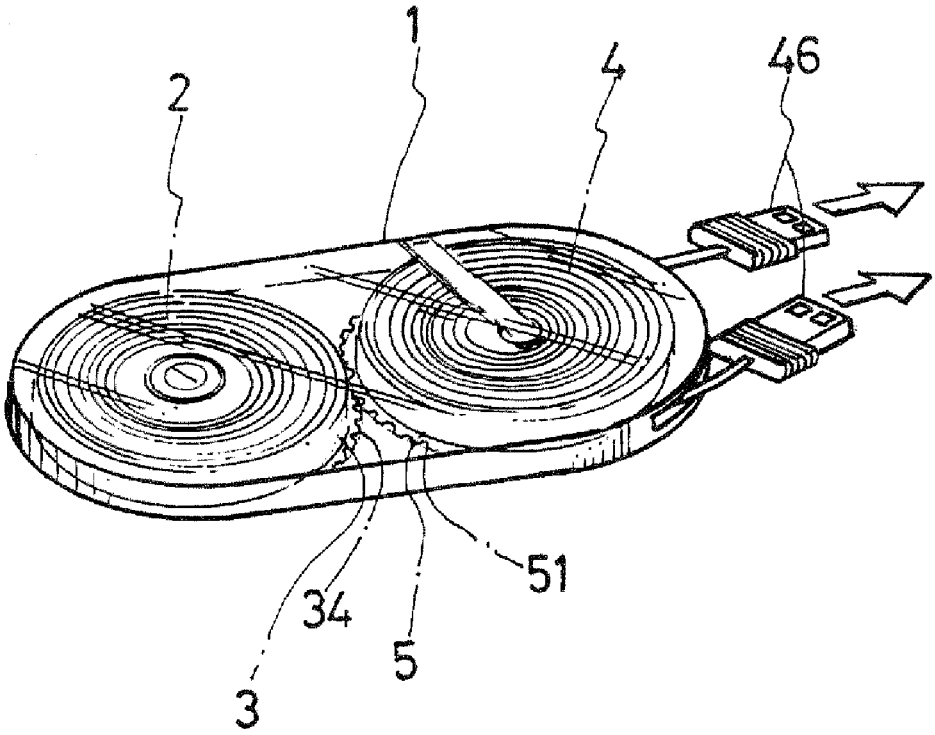
FIG. 6 is a perspective schematic diagram showing a thin cable retractor according to another embodiment of the present invention which provides a retractable cable with two connectors at a free end.

As shown in FIG. 7, the cable 4 is bended at a central location 45 and the central location 45 is fixed to the central axle 52. The entire cable 4 is then wound around the central axle 52 so that connectors 46 at the two ends of the cable 4 could be pulled and extended in the same direction, as shown in FIG. 6.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A thin cable retractor, comprising a housing member, a coil spring, a rotary disc, a cable, and a winding disc; wherein said rotary disc has a top indentation with a central through hole;

said rotary disc is rotatably and axially mounted on a pin of said housing member; a plurality of gear teeth are provided along a circumference of said rotary disc;

said coil spring, accommodated in said indentation, is tightened or loosed along with said rotary disc's rotation direction;

said winding disc positioned to a side of said rotary disc and has a plurality of gear teeth along a circumference of said winding disc which engages said gear teeth of said rotary disc; said winding disc is rotatably mounted to said housing member by a central axle; and said cable is wound around said central axle of said winding disc.

2. The thin cable retractor according to claim 1, wherein said coil spring has an inner end fixedly connected a top end of said pin, and an outer end fixedly connected to a circumferential wall of said indentation.

3. The thin cable retractor according to claim 1, wherein a spiral track and a centrifugal track are provided on a back side of said rotary disc and said housing member, respectively; a positioning ball is movably positioned inside said spiral track and said centrifugal track; together with said spiral track and said centrifugal track, said positioning ball provides a positioning function capable of temporarily stopping the extension and winding of said cable in successive steps.

4. The thin cable retractor according to claim 1, wherein a connector is configured at a free end of said cable; a positive wire and a negative wire out of the other end of said cable are connected to an upper embedded element and a lower embedded element, respectively; said upper embedded element then connects an upper conducting plate, and said lower embedded element connects a lower conducting plate; a positive and negative wires of another connector of are connected to said upper and lower conducting plates, respectively, at a fixed length.

5. The thin cable retractor according to claim 1, wherein said cable is bended at a central location; said central location is fixed to said central axle; said cable is then wound around said central axle so that two connectors at the two ends of said cable are freely pulled from or reeled back into said cable retractor.

* * * * *